US005385282A

United States Patent [19]

Chen

[11] Patent Number: 5,385,282

[45] Date of Patent: Jan. 31, 1995

[54] BEEPER HOLDER

[76] Inventor: Pao-Chin Chen, 4F, No. 292, Sec. 2, Chien Kuo S. Rd., Taipei, Taiwan, Prov. of China

[21] Appl. No.: 202,798

[22] Filed: Feb. 28, 1994

[51] Int. Cl.[6] ..... A45F 5/00

[52] U.S. Cl. ..... 224/252; 224/269; 24/3 J; 24/3 R; 455/351

[58] Field of Search ..... 224/252, 247, 269, 904; 24/3 G, 3 J, 3 R, 3 F, 3 L; 455/348, 351

[56] References Cited

U.S. PATENT DOCUMENTS

| | | | |
|---|---|---|---|
| 2,509,428 | 5/1950 | Greene | 224/269 X |
| 3,214,685 | 10/1965 | Brenner | 224/269 X |
| 4,741,074 | 5/1988 | Budano, II et al. | 24/3 J |
| 4,881,150 | 11/1989 | Oyamada | 24/3 J X |
| 5,081,709 | 1/1992 | Benyo et al. | 224/252 X |
| 5,235,728 | 8/1993 | Nordberg | 24/3 J |

*Primary Examiner*—J. Casimer Jacyna
*Attorney, Agent, or Firm*—Bucknam and Archer

[57] ABSTRACT

A beeper holder includes a casing having two lugs and a hook on the back at different elevations; a back plate having two mounting flanges bilaterally and perpendicularly disposed near a top side thereof and turned about a pivot pin connected between the lugs on the casing, a projecting strip spaced between the mounting flanges, and a retaining hole near a bottom side thereof for receiving the hook on the casing; a clamping plate having two triangular mounting flanges bilaterally and perpendicularly disposed near a top side thereof and turned about the pivot pin between the mounting flanges of the back plate; and a substantially V-shaped spring plate having one end fastened to the projecting strip of the back plate and an opposite end stopped against the clamping plate causing the clamping plate clamped on the back plate.

4 Claims, 5 Drawing Sheets

BEEPER HOLDER

BACKGROUND OF THE INVENTION

The present invention relates to a beeper holder for carrying a beeper on the belt or waistband.

A beeper may be fastened with a clip at the back, as shown in FIG. 1, so that it can be hung on the user's belt or waistband. However, when the beeper is triggered, the user must bend the head and the trunk to read the display of the beeper.

FIG. 2 shows a prior art beeper holder for fastening to the belt or waistband to carry a beeper. When the beeper is triggered, the user can remove the beeper from the beeper holder to read the display. After reading, the beeper is put back to the beeper holder again. This structure of beeper holder is still not satisfactory in function because the beeper must be removed from the beeper holder when reading or the user shall have to bend the head and the truck in order to see the display of the beeper.

SUMMARY OF THE INVENTION

The present invention provides a beeper holder which eliminates the aforesaid drawbacks. According to the present invention, the beeper holder comprises a casing for carrying a beeper, a back plate pivoted to the casing at the back, a clamping plate pivoted to the back plate for fastening to the belt or waistband, and a spring plate fastened to the back plate and stopped against the clamping plate to give a pressure to the clamping plate causing it clamped on the back plate. Because the back plate is pivoted to the casing, the casing can be turned to move the beeper from the vertical position to the horizontal position for reading the display conveniently when the beeper is triggered. According to an alternate form of the present invention, the casing is directly molded on the shell of the beeper.

DETAILED DESCRIPTION OF THE PREFERRED EMBODIMENT

Figure 2:
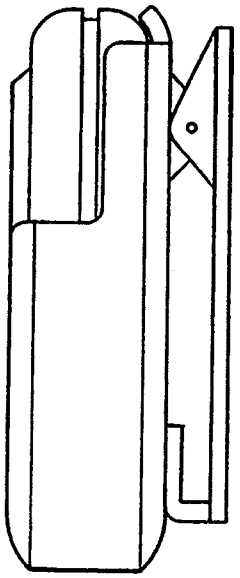
FIG. 2 is a side view showing a beeper fastened to a beeper holder according to the prior art.
Figure 1:
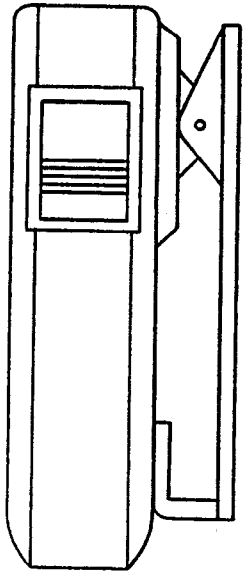
FIG. 1 is a side view showing a beeper having a beeper clip according to the prior art.
Figure 3:
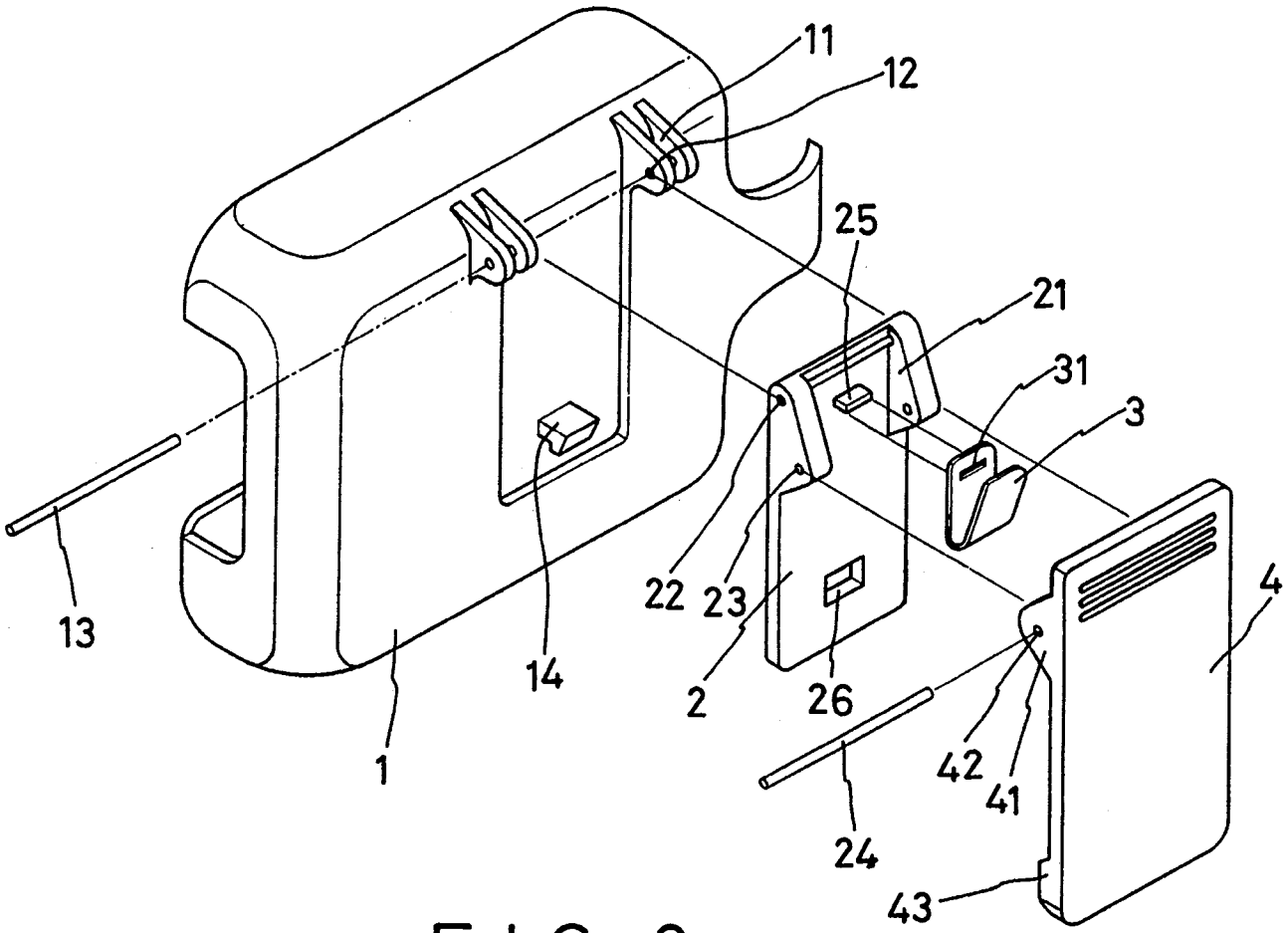
FIG. 3 is an exploded view of a beeper holder according to one embodiment of the present invention.

Referring to FIG. 3, a beeper holder in accordance with the preferred embodiment of the present invention is generally comprised of a casing 1, a back plate 2, a spring plate 3, and a clamping plate 4.

Figure 5:
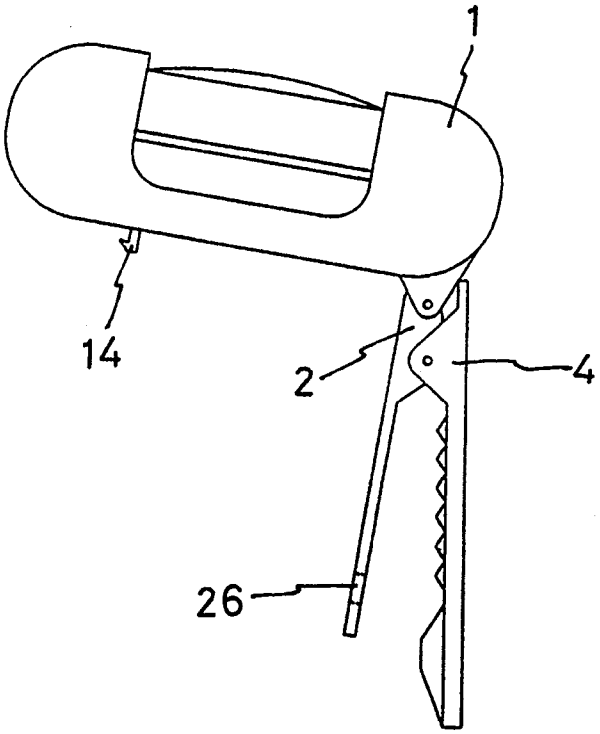
FIG. 5 is similar to FIG. 4 but showing the casing turned from the back plate.
Figure 6:
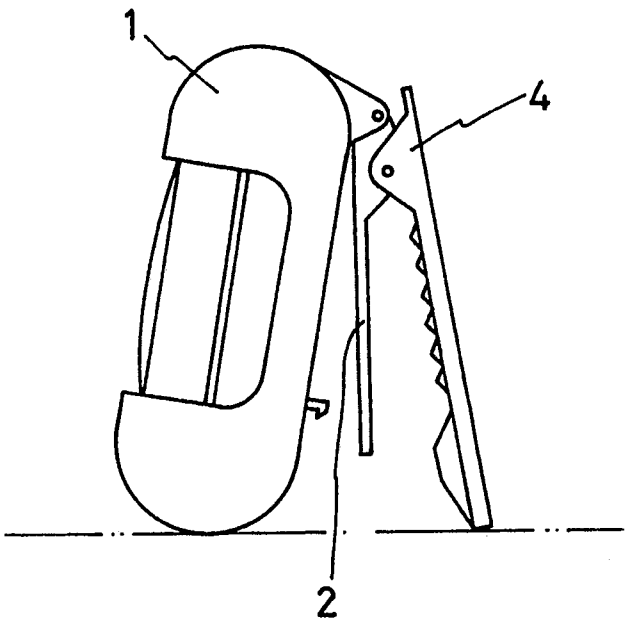
FIG. 6 shows the beeper holder of FIG. 4 supported on a flat surface in a sloping position.
Figure 7:
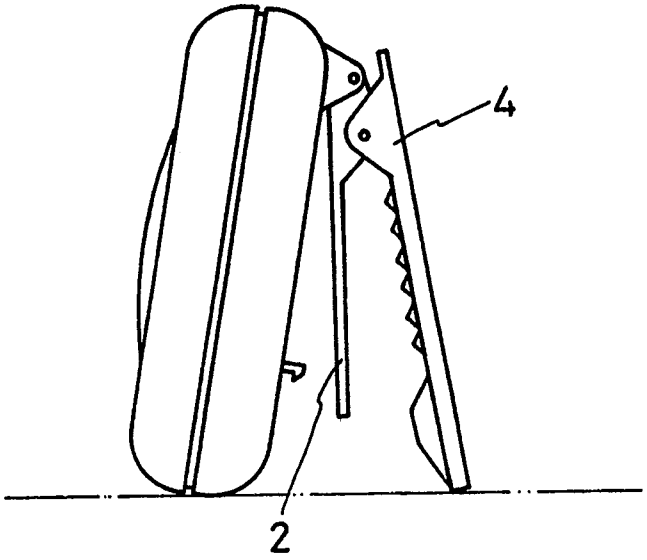
FIG. 7 is a side view of an alternate form of the beeper holder of the present invention.

The casing 1 can be the body of a beeper (as shown in FIG. 7) or a semi-enclosed covering for carrying a beeper (as shown in FIGS. 3 through 6). The casing 1 has two lugs 11 and a hook 14 spaced on the back thereof, wherein the lugs 11 have a respective eyelet hole 12 aligned with each other; the hook 14 is equally spaced from the lugs 11 at a different elevation. The back plate 2 is a flat plate, having two flat, triangular mounting flanges 21 bilaterally and perpendicularly disposed near the top side thereof, which have a respective first pin hole 22 and a respective second pin hole 23, a projecting strip 25 spaced between the mounting flanges 21, and a retaining hole 26 equally spaced from the mounting flanges 21 and the projecting strip 25 at a different elevation, which receives the hook 14 on the casing 1. By inserting a pivot pin 13 through the eyelet holes 12 on the lugs 11 of the casing 1 and the first pin hole 22 on each mounting flange 21 of the back plate 2, the back plate 2 is pivoted to the casing 1 and can be turned about the pivot pin 13. The spring plate 3 is made by bending a rigid material into a substantially V-shaped configuration, having a retaining hole 31 at one end mounted on the projecting strip 25 of the back plate 2. The opposite end of the spring plate 3 is stopped against the clamping plate 4. The clamping plate 4 is a flat plate, having two flat, triangular mounting flanges 41 bilaterally and perpendicularly disposed near the top side thereof, which have a respective pin hole 42 connected to the second pin hole 23 on either flange 21 of the back plate 2 by a pivot pin 24, two retainer flanges 43 bilaterally and perpendicularly disposed near the bottom side thereof, and a serrated inside surface 44 spaced between the mounting flanges 41 and the retainer flanges 43 and facing the back plate 2.

Figure 4:
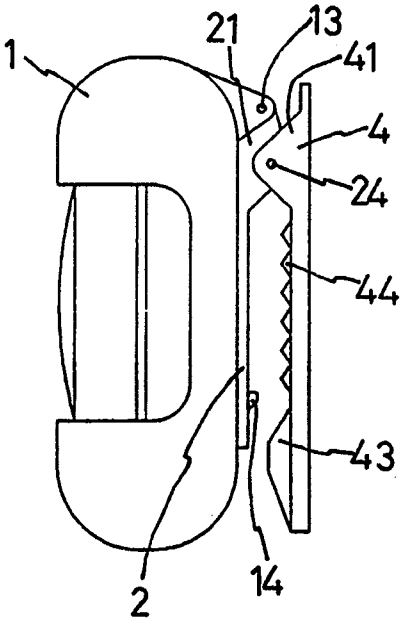
FIG. 4 is a side view of the beeper holder shown in FIG. 3.

When assembled, as shown in FIG. 4, the clamping plate 4 is acted by the spring plate 3 causing the retainer flanges 43 moved toward the bottom side of the back plate 2, and therefore the the back plate 2 and the clamping plate 4 can be clamped on the belt or waistband. When the beeper is fastened to the casing 1, the hook 14 on the casing 1 is forced to hook in the retaining hole 26.

Referring to FIG. 5, when the beeper is triggered to beep, the casing 1 can be turned from the back plate 2 to release the hook 14 from the retaining hole 26 and to moved the beeper from the vertical position to the horizontal position for reading the signal displayed. After reading, the casing 1 is released from the hand, and it turns back to the back plate 2 causing the hook 14 hooked in the retaining hole 26 again.

Referring to FIG. 6, the casing 1 can be turned from the back plate 2 and supported on the desk in a sloping position to show the display of time (a normal beeper has the function of measuring time).

Referring to FIG. 7, therein illustrated is an alternate form of the present invention, in which the casing 1 is directly molded on the back side of the beeper (namely, the casing 1 is part of the shell of the beeper).

While only few embodiments of the present invention have been shown and described, it will be understood that various modifications and changes could be made without departing from the scope and spirit of the invention.

What is claimed is:

1. A beeper holder comprising:

a casing for holding the beeper having two unitary lugs and a unitary hook respectively raised from a back side thereof at different elevations, and a first pivot pin connected between said lugs;

a flat back plate, having two flat, triangular mounting flanges bilaterally and perpendicularly disposed near a top side thereof and turned about said first pivot pin, a second pivot pin connected between the mounting flanges of said back plate, a projecting strip disposed between said two mounting flanges and spaced below the second pivot pin on said mounting flanges, and a retaining hole equally spaced from said mounting flanges and said projecting strip and disposed near a bottom side thereof for receiving said hook of said casing;

a flat clamping plate having two flat, triangular mounting flanges bilaterally and perpendicularly disposed near a top side thereof and turned about said second pivot pin, and two retainer flanges bilaterally and perpendicularly disposed near a bottom side thereof; and a substantially V-shaped spring plate having one end fastened to said projecting strip of said back plate and an opposite end stopped against said clamping plate causing the retainer flanges of said clamping plate moved to the bottom side of said back plate.

2. The beeper holder of claim 1 wherein said clamping plate has a serrated inside surface spaced between said mounting flanges and said retainer flanges and facing said back plate.

3. The beeper holder of claim 1 wherein said casing is part of the shell of a beeper.

4. The beeper holder of claim 1 wherein said casing has a semi-enclosed covering for carrying a beeper.

* * * * *